US011454237B2

(12) United States Patent
Noh et al.

(10) Patent No.: US 11,454,237 B2
(45) Date of Patent: Sep. 27, 2022

(54) SCROLL COMPRESSOR

(71) Applicant: SAMSUNG ELECTRONICS CO., LTD., Suwon-si (KR)

(72) Inventors: Jongsoo Noh, Suwon-si (KR); Sunghyuk Park, Suwon-si (KR); Mooseong Bae, Suwon-si (KR); Sungchan Cho, Suwon-si (KR); Sungkwang Oh, Suwon-si (KR); Yanghee Cho, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/942,190

(22) Filed: Jul. 29, 2020

(65) Prior Publication Data

US 2021/0033092 A1 Feb. 4, 2021

(30) Foreign Application Priority Data

Jul. 30, 2019 (KR) ..... 10-2019-0092268
Jul. 13, 2020 (KR) ..... 10-2020-0086090

(51) Int. Cl.
*F04C 18/02* (2006.01)
*F04C 29/00* (2006.01)
*F04C 23/00* (2006.01)

(52) U.S. Cl.
CPC ..... *F04C 18/0215* (2013.01); *F04C 23/008* (2013.01); *F04C 18/0269* (2013.01); *F04C 29/0057* (2013.01); *F04C 2240/40* (2013.01)

(58) Field of Classification Search
CPC ..... F04C 18/0269; F04C 18/0215; F04C 29/0057; F04C 18/02–0292; F04C 2/025
(Continued)

(56) References Cited

U.S. PATENT DOCUMENTS 5,318,424 A * 6/1994 Bush ..... F04C 18/0269 418/55.2
5,458,471 A * 10/1995 Ni ..... F04C 27/005 418/1

(Continued)

FOREIGN PATENT DOCUMENTS

JP 7-310681 11/1995
JP 2932013 B2 8/1999

(Continued)

OTHER PUBLICATIONS

Rajaa Issa "Essential Mathematics for Computational Design" (Year: 2013).*

(Continued)

*Primary Examiner* — Mark A Laurenzi
*Assistant Examiner* — Xiaoting Hu
(74) *Attorney, Agent, or Firm* — Staas & Halsey LLP

(57) ABSTRACT

Provided is a scroll compressor capable of expanding a compression space and accordingly increasing a design volume ratio. The scroll compressor includes: a main body; a fixed scroll fixed inside the main body; an orbiting scroll orbiting the fixed scroll; and a plurality of compressing portions respectively provided in the fixed scroll and the orbiting scroll, wherein each compressing portion includes a circular arc portion of which a curvature is constant, a curved portion positioned in an inside of the circular arc portion and spaced a preset distance from the circular arc portion, and a connection portion connecting the circular arc portion to the curved portion, wherein a curvature of the connection portion changes from the first circular arc portion to the second circular arc portion.

15 Claims, 12 Drawing Sheets

(58) Field of Classification Search
USPC ..... 418/55.2
See application file for complete search history.

(56) References Cited

U.S. PATENT DOCUMENTS

| | | | | |
|---|---|---|---|---|
| 5,938,417 | A * | 8/1999 | Takao | F04C 18/0246 418/55.2 |
| 2014/0363325 | A1 | 12/2014 | Park et al. | |
| 2015/0037189 | A1* | 2/2015 | Inada | F01C 1/0269 418/55.2 |
| 2016/0053759 | A1 | 2/2016 | Choi et al. | |
| 2017/0306953 | A1* | 10/2017 | Choi | F04C 18/0269 |
| 2019/0072092 | A1* | 3/2019 | Kim | F04C 18/0269 |

FOREIGN PATENT DOCUMENTS

| | | | |
|---|---|---|---|
| JP | 3110970 | B2 | 11/2000 |
| JP | 3170111 | B2 | 5/2001 |
| JP | 2001-221169 | A | 8/2001 |
| JP | 3708573 | B2 | 10/2005 |
| JP | 2012-241631 | A | 12/2012 |
| JP | 2013-177867 | A | 9/2013 |
| JP | 2013-194721 | A | 9/2013 |
| KR | 10-2013-0031734 | A | 3/2013 |
| KR | 10-2013-0031735 | A | 3/2013 |
| KR | 10-2013-0031736 | A | 3/2013 |
| KR | 10-1282227 | B1 | 7/2013 |
| KR | 10-1285618 | B1 | 7/2013 |
| KR | 10-1285619 | B1 | 7/2013 |

OTHER PUBLICATIONS

Rhino "What are NURBS?" retrieved Mar. 3, 2022 from https://www.rhino3d.com/features/nurbs/ (Year: 2022).*

European Office Action dated Aug. 3, 2022 in European Patent Application No. 20847631.7 (7 pages).

* cited by examiner

SCROLL COMPRESSOR

CROSS-REFERENCE TO RELATED APPLICATION

This application is based on and claims priority under 35 U.S.C. § 119 to Korean Patent Application Nos. 10-2019-0092268 and 10-2020-0086090, filed on Jul. 30, 2019 and Jul. 13, 2020 in the Korean Intellectual Property Office, the disclosure of which is incorporated by reference herein in its entirety.

BACKGROUND

1. Field

The disclosure relates to a scroll compressor.

2. Description of the Related Art

A scroll compressor is a compressor including a fixed scroll having a fixing wrap and an orbiting scroll having an orbiting wrap corresponding to the fixing wrap of the fixed scroll, wherein the orbiting scroll orbits the fixed scroll to form a compression chamber moving continuously between the fixing wrap and the orbiting wrap to inhale and compress a refrigerant.

The scroll compressor is excellent compared to other types of compressors in view of vibrations and noise that are generated during an operation, because inhalation, compression, and discharge are performed successively.

In general, in an orbiting scroll of a scroll compressor, an orbiting wrap is formed on one side of a disk-shaped end plate, a boss portion is formed on the other side of the end plate where no orbiting wrap is formed, and a rotation shaft for driving the orbiting scroll is coupled to the boss portion. The scroll compressor is capable of reducing the diameter of the end plate because the orbiting wrap is formed over the entire area of the end plate. However, an action point at which a repulsive force of a refrigerant is applied upon compression is spaced from an action point at which a reaction force for cancelling the repulsive force is applied, so that the behavior of the orbiting scroll may become unstable upon an operation, and accordingly, the scroll compressor may cause great vibrations or noise.

As an alternative to the scroll compressor described above, a shaft penetration scroll compressor or a semi shaft penetration scroll compressor in which an action point at which a repulsive force of a refrigerant is applied and an action point for cancelling the repulsive force is applied are at the same location has been disclosed. The shaft penetration scroll compressor or the semi shaft penetration scroll compressor prevents an orbiting scroll from being inclined with respect to a rotation shaft, because the action point of the repulsive force of the refrigerant and the action point of the reaction force are at the same location.

However, the shaft penetration scroll compressor or the semi shaft penetration scroll compressor may not form an orbiting wrap over the entire area of an end plate because the rotation shaft needs to be inserted in the center portion of the end plate. Therefore, a compression space of a compression chamber is reduced, and furthermore, a design volume ratio of the scroll compressor is reduced.

SUMMARY

Therefore, it is an aspect of the disclosure to provide a scroll compressor capable of increasing a design volume ratio by changing a shape of a wrap.

It is another aspect of the disclosure to provide a scroll compressor capable of expanding a compression space by changing a shape of a wrap.

It is another aspect of the disclosure to provide a shaft penetration scroll compressor or a semi shaft penetration scroll compressor capable of increasing a design volume ratio by including a new shape of a wrap structure.

Additional aspects of the disclosure will be set forth in part in the description which follows and, in part, will be obvious from the description, or may be learned by practice of the disclosure.

In accordance with a concept of the disclosure, a scroll compressor includes: a main body; a fixed scroll fixed inside the main body; an orbiting scroll orbiting the fixed scroll; and a plurality of compressing portions respectively provided in the fixed scroll and the orbiting scroll, wherein each compressing portion includes a circular arc portion of which a curvature is constant, a curved portion positioned in an inside of the circular arc portion and spaced a preset distance from the circular arc portion, and a connection portion connecting the circular arc portion to the curved portion, wherein a curvature of the connection portion changes from the circular arc portion to the curved portion.

The connection portion may be in any one shape of a cosine curve, a Bezier curve, a Hermite curve, and a B-spline curve.

An included angle $\alpha$ of a first line segment connecting one end of the connection portion to a center of the compressing portion and a second line segment connecting the other end of the connection portion to the center of the compressing portion may be 100° or more.

When the curved portion is in a shape of an arc having a constant curvature, the circular arc portion may be referred to as a first circular arc portion, and the curved portion may be referred to as a second circular arc portion.

Each of the first circular arc portion and the second circular arc portion may have a constant thickness, and the thickness of the first circular arc portion may be the same as the thickness of the second circular arc portion.

The scroll compressor may further include a rotation shaft rotating with respect to a rotation axis and including an eccentric portion being eccentric from the rotation axis, wherein the eccentric portion is positioned alongside the compressing portion in a direction crossing the rotation axis.

The compressing portion may further include a shaft coupling portion positioned in an inside of the second circular arc portion and spaced a preset distance from the second circular arc portion, wherein the eccentric portion is coupled to the shaft coupling portion.

The shaft coupling portion may include a third circular arc portion forming an outer surface of the shaft coupling portion, wherein a curvature of the third circular arc portion is constant.

A distance between the first circular arc portion and the second circular arc portion may be equal to a distance between the second circular arc portion and the third circular arc portion.

The connection portion may include: a first connection portion connecting the first circular arc portion to the second circular arc portion, and a second connection portion connecting the second circular arc portion to the third circular arc portion, wherein a curvature of the second connection portion changes from the second circular arc portion to the third circular arc portion.

Each of the first circular arc portion and the second circular arc portion may include an outer surface and an inner surface, and the third circular arc portion may include an outer surface.

The first connection portion may include a first connection surface connecting the outer surface of the first circular arc portion to the outer surface of the second circular arc portion, and a second connection surface connecting the inner surface of the first circular arc portion to the inner surface of the second circular arc portion.

The second connection portion may include a third connection surface connecting the outer surface of the second circular arc portion to the outer surface of the third circular arc portion.

A first angle which is an included angle of a line segment connecting one end of the first connection surface to the center of the compressing portion and a line segment connecting the other end of the first connection surface to the center of the compressing portion, a second angle which is an included angle of a line segment connecting one end of the second connection surface to the center of the compressing portion and a line segment connecting the other end of the second connection surface to the center of the compressing portion, and a third angle which is an included angle of a line segment connecting one end of the third connection surface to the center of the compressing portion and a line segment connecting the other end of the third connection surface to the center of the compressing portion may be different from each other.

The first angle may be 95°, the second angle may be 115°, and the third angle may be 135°.

When a distance from a center of the compressing portion to the connection portion is R, a distance from the center of the compressing portion to the first circular arc portion is $R_1$, a distance from the center of the compressing portion to the second circular arc portion is $R_2$, a thickness of the first circular arc portion is t, a distance by which a center of the eccentric portion is eccentric from a center of the rotation shaft is ε, an angle of one end of the first circular arc portion with respect to a preset reference line is $\theta_1$, an angle of one end of the second circular arc portion with respect to the preset reference line is $\theta_2$, and an angle of a point of the connection portion with respect to the preset reference line is θ, $$R = R_1 - (\varepsilon + t) + (\varepsilon + t)\cos\varphi,\ \varphi = -\frac{180}{\alpha}\cos(\theta - \theta_1),\ \alpha = \theta_1 - \theta_2$$

may be satisfied.

A center of the shaft coupling portion may be out of a center of the compressing portion.

The curved portion may be in a shape of an involute curve having a center which is off set from a center of the fixed scroll or the orbiting scroll. In accordance with a concept of the disclosure, a scroll compressor includes: a main body; a fixed scroll fixed inside the main body; an orbiting scroll orbiting the fixed scroll; and a plurality of compressing portions respectively provided in the fixed scroll and the orbiting scroll, wherein each compressing portion includes a first circular arc portion being in a shape of an arc, a second circular arc portion positioned in an inside of the first circular arc portion, wherein a center of the second circular arc portion is at the same location as a center of the first circular arc portion, and a thickness of the second circular arc portion is the same as a thickness of the first circular arc portion, and a connection portion connecting the first circular arc portion to the second circular arc portion, wherein a curvature of the connection portion changes successively from the first circular arc portion to the second circular arc portion.

The connection portion may be in a shape of a cosine curve.

An included angle α of a first line segment connecting one end of the connection portion to a center of the compressing portion and a second line segment connecting the other end of the connection portion to the center of the compressing portion may be 100° or more.

The scroll compressor may further include a rotation shaft rotating with respect to a rotation axis and including an eccentric portion being eccentric from the rotation axis, wherein the eccentric portion is positioned alongside the compressing portion in a direction crossing the rotation axis.

When a distance from a center of the compressing portion to the connection portion is R, a distance from the center of the compressing portion to the first circular arc portion is $R_1$, a distance from the center of the compressing portion to the second circular arc portion is $R_2$, a thickness of the first circular arc portion is t, a distance by which a center of the eccentric portion is eccentric from a center of the rotation shaft is ε, an angle of one end of the first circular arc portion with respect to a preset reference line is $\theta_1$, an angle of one end of the second circular arc portion with respect to the preset reference line is $\theta_2$, and an angle of a point of the connection portion with respect to the preset reference line is θ, $$R = R_1 - (\varepsilon + t) + (\varepsilon + t)\cos\varphi,\ \varphi = -\frac{180}{\alpha}\cos(\theta - \theta_1),\ \alpha = \theta_1 - \theta_2$$

may be satisfied.

In accordance with a concept of the disclosure, a scroll compressor includes: a main body; a fixed scroll fixed inside the main body and including a first end plate and a fixing wrap formed on the first end plate; an orbiting scroll orbiting the fixed scroll, and including a second end plate being opposite to the first end plate, and an orbiting wrap and a shaft coupling portion formed in the second end plate; and a rotation shaft including an eccentric portion being eccentric from a rotation axis, the rotation shaft coupled to the shaft coupling portion, wherein the eccentric portion penetrates the second end plate, wherein the orbiting wrap includes a first circular arc portion being in a shape of an arc, a second circular arc portion positioned in an inside of the first circular arc portion and spaced from the first circular arc portion, and a connection portion connecting the first circular arc portion to the second circular arc portion, wherein a curvature of the connection portion changes from the first circular arc portion to the second circular arc portion.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Configurations illustrated in the embodiments and the drawings described in the present specification are only the preferred embodiments of the disclosure, and thus it is to be understood that various modified examples, which may replace the embodiments and the drawings described in the present specification, are possible when filing the present application.

Also, the terms used in the present specification are merely used to describe embodiments, and are not intended to limit and/or restrict the disclosure. An expression used in the singular encompasses the expression of the plural, unless it has a clearly different meaning in the context. In the present specification, it is to be understood that the terms such as "including" or "having," etc., are intended to indicate the existence of the features, numbers, operations, components, parts, or combinations thereof disclosed in the specification, and are not intended to preclude the possibility that one or more other features, numbers, operations, components, parts, or combinations thereof may exist or may be added.

Also, it will be understood that, although the terms "first", "second", etc., may be used herein to describe various components, these components should not be limited by these terms. The above terms are used only to distinguish one component from another. For example, a first component discussed below could be termed a second component, and similarly, a second component may be termed a first component without departing from the scope of right of the disclosure.

In the following description, the terms "front end", "rear end", "upper portion", "lower portion", "upper end", and "lower end" are defined based on the drawings, and the shapes and positions of the corresponding components are not limited by the terms.

Throughout the disclosure, the expression "at least one of a, b or c" indicates only a, only b, only c, both a and b, both a and c, both b and c, all of a, b, and c, or variations thereof.

Figure 1:
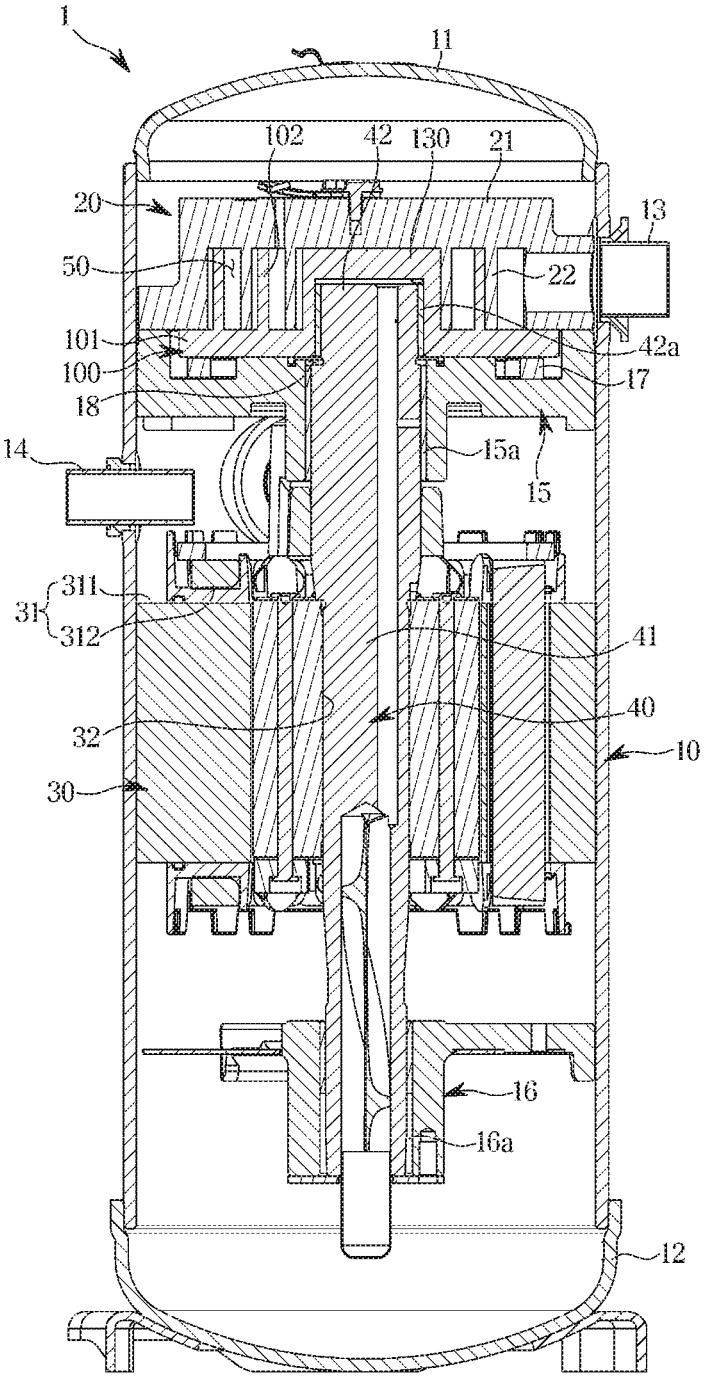
FIG. 1 is a longitudinal sectional view of a scroll compressor according to an embodiment of the disclosure.

FIG. 1 is a longitudinal sectional view of a scroll compressor according to an embodiment of the disclosure.

A scroll compressor 1 may include a main body 10, a fixed scroll 20 fixed inside the main body 10, an orbiting scroll 100 orbiting the fixed scroll 20, compressing portions 22 and 102 respectively provided in the fixed scroll 20 and the orbiting scroll 100, and a driving motor 30 for driving the orbiting scroll 100.

The main body 10 may include an upper cap 11 and a lower cap 12 respectively mounted on a top end and a lower end of the main body 10 to seal an inside of the main body 10, a suction pipe 13 which a refrigerant enters, and a discharge pipe 14 for discharging the refrigerant entered the suction pipe 13 to an outside of the main body 10 after the refrigerant is compressed.

The fixed scroll 20 may include a first end plate 21 being in a shape of a disk, and a fixing wrap 22 extending downward from the first end plate 21 and forming a compression chamber together with an orbiting wrap 102 which will be described later.

The orbiting scroll 100 may include a second end plate 101 being opposite to the first end plate 21 and being in a shape of a disk, and the orbiting wrap 102 extending upward from the second end plate 101 and forming the compression chamber together with the fixing wrap 22. Also, the orbiting scroll 100 may include a shaft coupling portion 130 in which an eccentric portion 42 of a rotation shaft 40 which will be described later is inserted.

Hereinafter, the compressing portions 22 and 102 may include the orbiting wrap 102 of the orbiting scroll 100 and the fixing wrap 22 of the fixed scroll 20. That is, the compressing portions 22 and 110 may indicate all of the orbiting wrap 102 and the fixing wrap 22.

The fixing wrap 22 of the fixed scroll 20 may be engaged with the orbiting wrap 102 of the orbiting scroll 100 to form a compression chamber 50. The compression chamber 50 may be formed by the fixed scroll 20 and the orbiting scroll 100, and a volume of the compression chamber 50 may be reduced by an orbiting motion of the orbiting scroll 100. Therefore, a refrigerant entered the compression chamber 50 may be compressed.

A refrigerant entered the compression chamber 50 and compressed may be discharged as a high-pressure refrigerant, and a refrigerant existing inside the compression chamber 50 may press the orbiting scroll 100 in a direction in which the orbiting scroll 100 is away from the fixed scroll 20.

Because inside pressure of the compression chamber 50 is applied in a direction in which the orbiting scroll 100 is away from the fixed scroll 20, a back pressure chamber 18 for transferring pressure in a direction in which the orbiting scroll 100 faces the fixed scroll 20 may be provided below the orbiting scroll 100.

A refrigerant may be filled in an inside of the back pressure chamber 18. The back pressure chamber 18 may be formed by a main frame 15, the rotation shaft 40, and the orbiting scroll 100.

An Oldham's ring 17 for orbiting the orbiting scroll 100 without revolving the orbiting scroll 100 may be provided between the orbiting scroll 100 and the main frame 15.

The main frame 15 and a sub frame 16 may be respectively fixed on upper and lower portions of an inner surface of the main body 10, and the driving motor 30 may be positioned between the main frame 15 and the sub frame 16.

The driving motor 30 may include a stator 31 and a rotor 32.

The stator 31 may include a stator body 311, and a coil 312 wound around the stator body 311.

The stator body 311 may be a laminate formed by stacking a plurality of electrical steel sheets, and may be substantially in a shape of a cylinder, wherein a diameter of an outer circumference surface of the stator body 311 may be larger than a diameter of an inner circumference surface of the main body 10, and therefore, the stator body 311 may be fitted in the main body 10 by interference fit.

The stator body 311 may include a plurality of teeth (not shown) arranged in a circumference direction on the inner portion that is opposite to an outer circumference of the rotor 32. The coil 312 may be positioned at a slot (not shown) existing between neighboring teeth.

The rotor 32 may be a laminate formed by stacking a plurality of electrical steel sheets each being in a shape of a ring. A diameter of an inner circumference surface of the rotor 32 may be smaller than a diameter of an outer circumference surface of the rotation shaft 40. The rotation shaft 40 may be fitted in the rotor 32 by interference fit. A method of fitting the rotation shaft 40 in the rotor 32 may be press-fit. Therefore, the rotation shaft 40 may rotate together with the rotor 32.

The rotation shaft 40 may include a main shaft 41 inserted in the rotor 32, and an eccentric portion 42 positioned at an upper portion of the main shaft 41 and having a shaft center being eccentric from a shaft center of the main shaft 41.

The rotation shaft 40 may be installed between the main frame 15 and the sub frame 16 to transfer a rotation force generated by the driving motor 30 to the orbiting scroll 100.

An upper portion of the rotation shaft 40 may be supported by the main frame 15 in such a way to be rotatable with respect to the main frame 15. The main frame 15 may include a main bearing 15*a* for supporting rotations of the rotation shaft 40.

A lower portion of the rotation shaft 40 may be supported by the sub frame 16 in such a way to be rotatable with respect to the sub frame 16. The sub frame 16 may include a sub bearing 16*a* for supporting rotations of the rotation shaft 40.

The orbiting scroll 100 may include the shaft coupling portion 130 in which the eccentric portion 42 is inserted. According to an embodiment of the disclosure, the shaft coupling portion 130 may protrude upward from the second end plate 101 of the orbiting scroll 100. By the structure, the eccentric portion 42 may protrude upward from the second end plate 101, and the eccentric portion 42 may be positioned alongside the orbiting wrap 102 and the fixing wrap 22.

The orbiting scroll 100 may include an orbiting bearing 42*a* positioned on an inner surface of the shaft coupling portion 130. The orbiting bearing 42*a* may support rotations of the eccentric portion 42.

The above-described structure of the orbiting scroll 100 is referred to as a semi shaft penetration structure, and hereinafter, a semi shaft penetration scroll compressor will be described as an example. However, the disclosure is not limited to the semi shaft penetration scroll compressor, and may be applied to a shaft penetration scroll compressor.

In the case of the semi shaft penetration scroll compressor or the shaft penetration scroll compressor, because an action point at which a repulsive force of a refrigerant is applied upon compression and an action point at which a reaction force for cancelling the repulsive force is applied are at the same location, vibrations or noise that may be caused by an inclination of an orbiting scroll may be prevented. However, in the case of the semi shaft penetration scroll compressor or the shaft penetration scroll compressor, a rotation shaft needs to be inserted in a center of an end plate of an orbiting scroll. Therefore, it is difficult to form an orbiting wrap over the entire area of the end plate, and accordingly, a compression space and a design volume ratio may be reduced. According to a concept of the disclosure, a scroll compressor capable of expanding a compression space and increasing a design volume ratio by improving a wrap shape while having a semi shaft penetration structure or a shaft penetration structure is disclosed.

Figure 2:
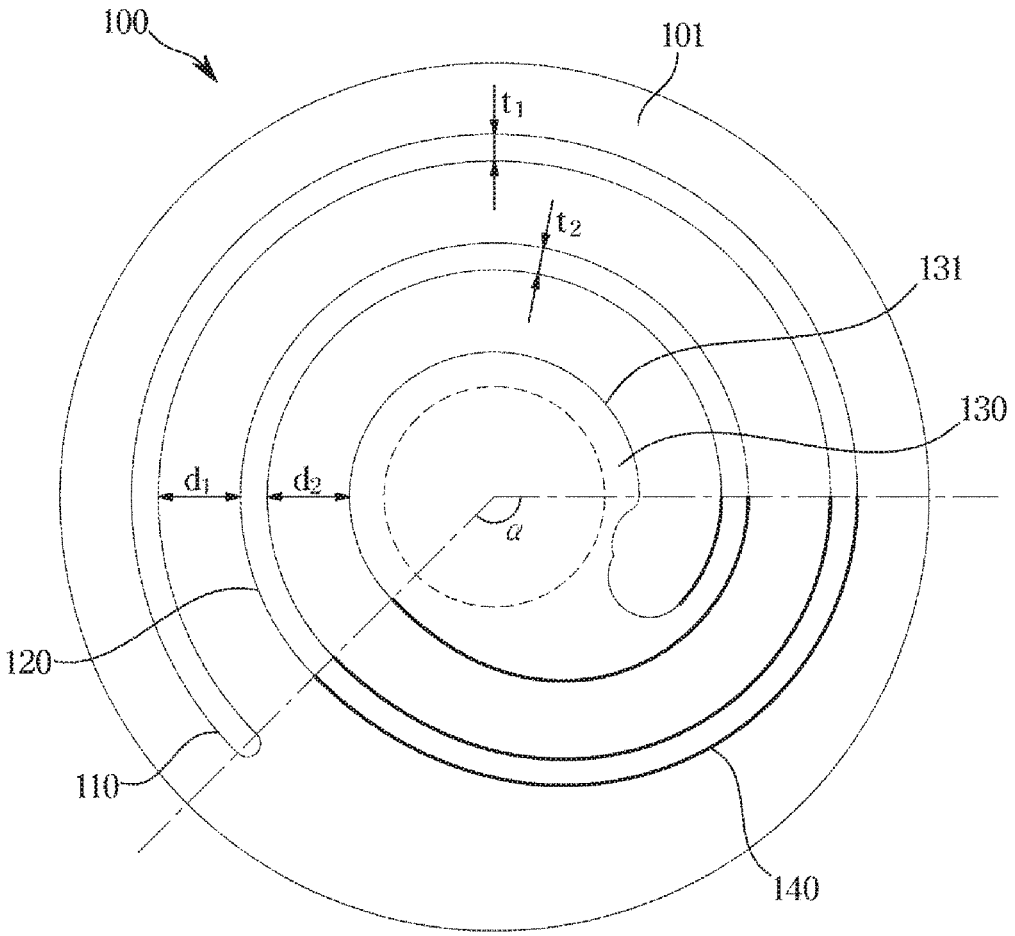
FIG. 2 is a top view of an orbiting scroll in a scroll compressor according to an embodiment of the disclosure.

FIG. 2 is a top view of the orbiting scroll 100 in the scroll compressor 1 according to an embodiment of the disclosure.

Hereinafter, an orbiting wrap shape of the orbiting scroll 100 will be described as an example. Due to characteristics of the scroll compressor 1, because a fixing wrap shape of the fixed scroll 20 corresponds to the orbiting wrap shape, the following descriptions may also be applicable to the fixing wrap 22 of the fixed scroll 20.

Referring to FIG. 2, the orbiting scroll 100 according to an embodiment of the disclosure may include the second end plate 101, and an orbiting wrap protruding upward from the second end plate 101.

The orbiting wrap may include a first circular arc portion 110 having a constant curvature, a second circular arc portion 120 positioned in an inside of the first circular arc portion 110 and having a constant curvature, and a connection portion 140 connecting the first circular arc portion 110 to the second circular arc portion 120.

The first circular arc portion 110 may be in a shape of an arc having a preset radius. The second circular arc portion 120 may also be in a shape of a arc, like the first circular arc portion 110, wherein a center of the second circular arc portion 120 may be at the same location as that of the first circular arc portion 110 and the radius of the second circular arc portion 120 may be smaller than that of the first circular arc portion 110.

In an inside of the second circular arc portion 120, the shaft coupling portion 130 may be positioned. An outer surface of the shaft coupling portion 130 may form a third circular arc portion 131. A center of the third circular arc portion 131 may be at the same location as those of the first circular arc portion 110 and the second circular arc portion 120, and the third circular arc portion 131 may be in a shape of an arc of which a radius is smaller than that of the second circular arc portion 120.

The first circular arc portion 110 may have a thickness t1, and the second circular arc portion 120 may have a thickness t2.

According to an embodiment of the disclosure, the thickness t1 of the first circular arc portion 110 may be the same as the thickness t2 of the second circular arc portion 120. Accordingly, t1=t2.

Also, a distance d1 between the first circular arc portion 110 and the second circular arc portion 120 may be equal to a distance d2 between the second circular arc portion 120 and the third circular arc portion 131. Accordingly, d1=d2.

Because each of the first circular arc portion 110 and the second circular arc portion 120 is formed in a shape of an arc which is a part of a circle having a constant radius, each of the first circular arc portion 110 and the second circular arc portion 120 may have a constant curvature.

According to a concept of the disclosure, the connection portion 140 connecting the first circular arc portion 110 to the second circular arc portion 120 may have a curvature changing from the first circular portion 110 to the second circular portion 120. The curvature of the connection portion 140 may change successively from the first circular arc portion 110 to the second circular arc portion 120. The connection portion 140 may be in any one shape of a cosine curve, a Bezier curve, a Hermite curve, or a B-spline curve. A detailed shape of the connection portion 140 will be described later.

According to an embodiment of the disclosure, an included angle α of a line segment connecting one end of the connection portion 140 to a center of the orbiting scroll 100 and a line segment connecting the other end of the connection portion 140 to the center of the orbiting scroll 100 may be 135°. The one end of the connection portion 140 may be a location at which the first circular arc portion 110 is connected to the connection portion 140, and the other end of the connection portion 140 may be a location at which the second circular arc portion 120 is connected to the connection portion 140.

Figure 3:
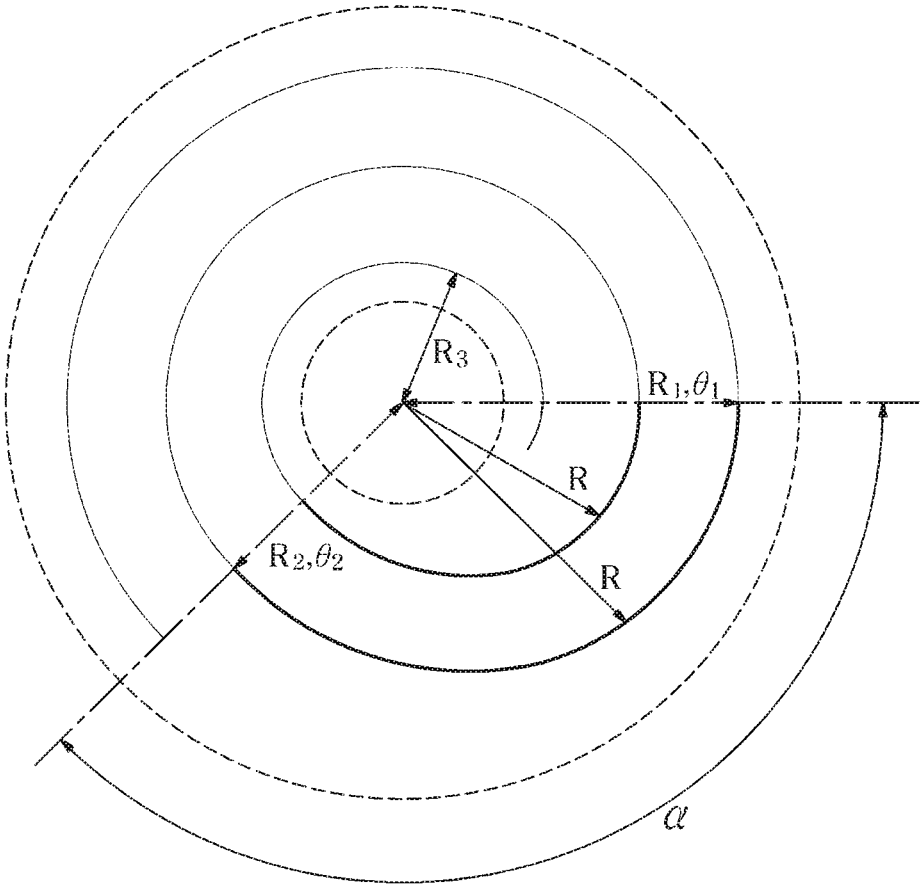
FIG. 3 schematically shows the orbiting scroll shown in FIG. 2.
Figure 4:
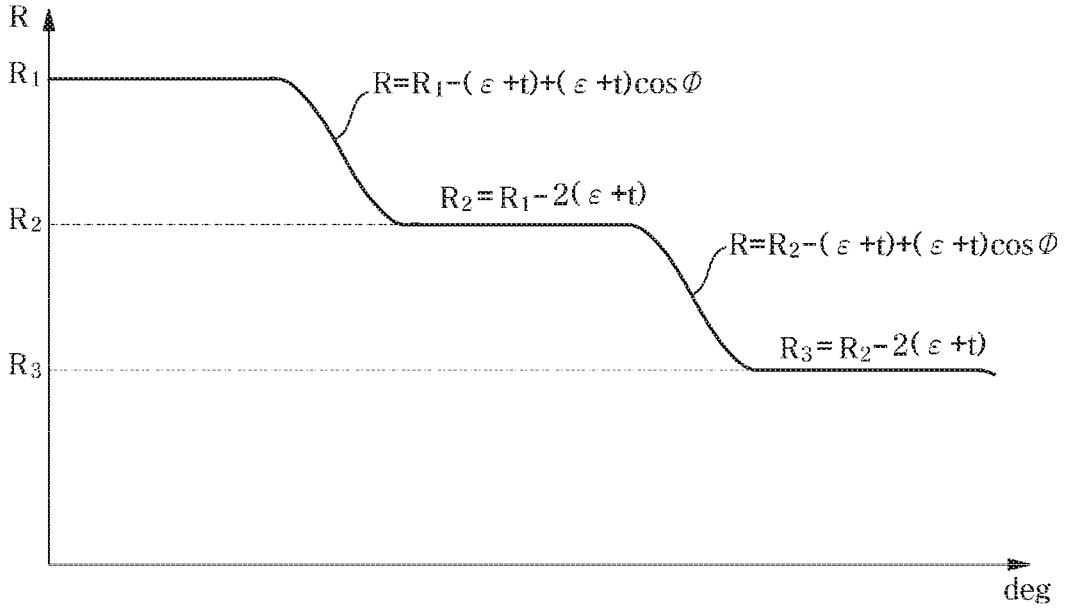
FIG. 4 is a graph showing a distance from a center of an orbiting scroll to an orbiting wrap in a scroll compressor according to an embodiment of the disclosure.
Figure 5:
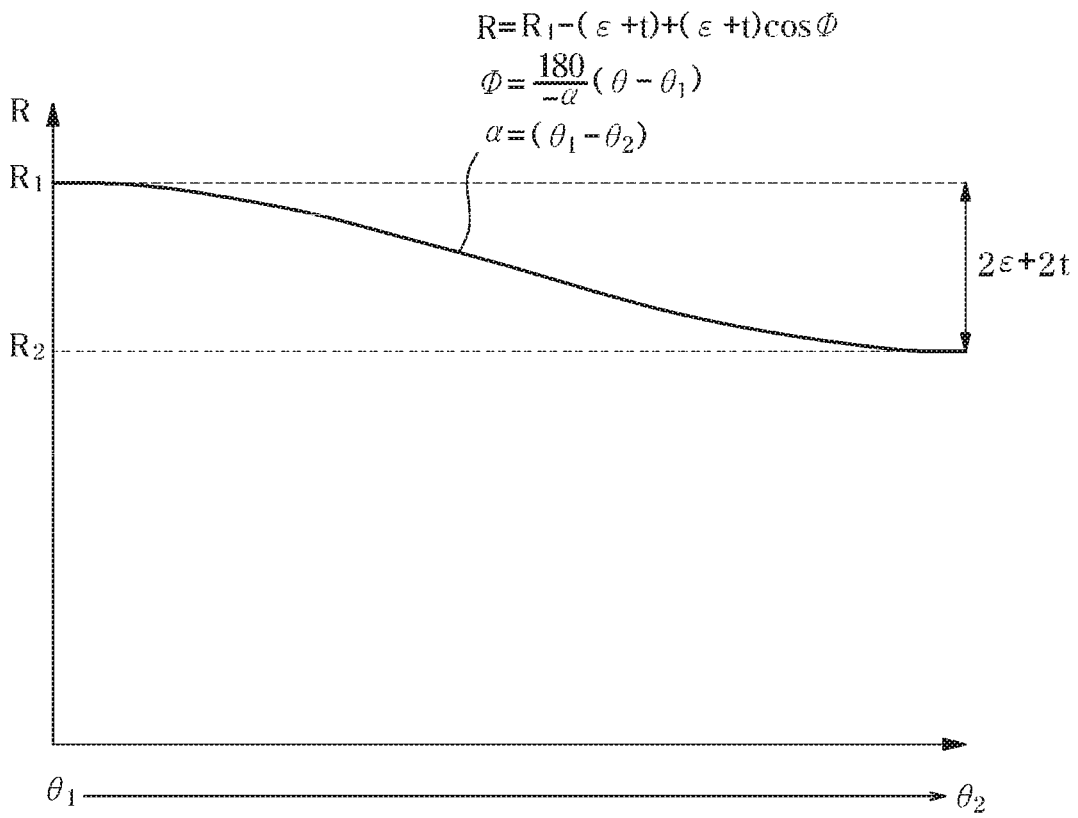
FIG. 5 is a graph obtained by enlarging a portion of the graph shown in FIG. 4.

FIG. 3 schematically shows the orbiting scroll 100 shown in FIG. 2. FIG. 4 is a graph showing a distance from the center of the orbiting scroll 100 to the orbiting wrap 102 in the scroll compressor 1 according to an embodiment of the disclosure. FIG. 5 is a graph obtained by enlarging a portion of the graph shown in FIG. 4.

FIG. 3 shows an outer surface of the first circular arc portion 110, an outer surface of the second circular arc portion 120, and outer surfaces of the third circular arc portion 131 and the connection portion 140, in the orbiting scroll 100 shown in FIG. 2.

In FIG. 3, $R_1$ indicates a distance from the center of the orbiting scroll 100 to the first circular arc portion 110, $R_2$ indicates a distance from the center of the orbiting scroll 100 to the second circular arc portion 120, and R indicates a distance from the center of the orbiting scroll 100 to the connection portion 140.

Also, $\theta_1$ indicates an angle of the one end of the connection portion 140 with respect to a preset reference line, $\theta_2$ indicates an angle of the other end of the connection portion 140 with respect to the preset reference line, and θ indicates an angle of a point of the connection portion 140 with respect to the preset reference line. The one end of the connection portion 140 may be a location at which the first circular arc portion 110 is connected to the connection portion 140, and the other end of the connection portion 140 may be a location at which the second circular arc portion 120 is connected to the connection portion 140.

Referring to FIG. 3, the distance $R_1$ from the center of the orbiting scroll 100 to the first circular arc portion 110 may be constant, and the distance $R_2$ from the center of the orbiting scroll 100 to the second circular arc portion 120 may also be constant. The connection portion 140 may connect the first circular arc portion 110 to the second circular arc portion 120 with a variable curvature, and a distance between the connection portion 140 and the center of the orbiting scroll 100 may change successively.

FIG. 4 is a graph showing a distance from the center of the orbiting scroll 100 to the connection portion 140 according to a change of an angle.

In FIG. 4, ε indicates a distance by which the shaft center of the eccentric portion 42 is eccentric from the shaft center of the main shaft 41, and t indicates the thickness of the first circular arc portion 110 and the second circular arc portion 120.

As shown in FIG. 4, the distance R from the center of the orbiting scroll 100 to the connection portion 140 may satisfy the following equation.

$$R=R_1-(\varepsilon+t)+(\varepsilon+t)\cos\varphi$$

When the connection portion 140 connecting the first circular arc portion 110 to the second circular arc portion 120 is referred to as a first connection portion and a connection portion connecting the second circular arc portion 120 to the third circular arc portion 131 is referred to as a second connection portion, a distance R between the second connection portion and the center of the orbiting scroll 100 may satisfy the following equation.

$$R=R_2-(\varepsilon+t)+(\varepsilon+t)\cos\varphi$$

More specifically, referring to FIG. 5, the distance R between the connection portion and the center of the orbiting scroll 100 from one end of the connection portion 140 to the other end of the connection portion 140 may satisfy the following equation.

$$R = R_1 - (\varepsilon + t) + (\varepsilon + t)\cos\varphi,\ \varphi = -\frac{180}{\alpha}\cos(\theta - \theta_1),\ \alpha = \theta_1 - \theta_2$$

It is seen from the above equation that the connection portion is in a shape of a cosine curve. Also, it is seen that the connection portion is in a shape of a cosine curve ranging from 0° to 180°, regardless of α.

Although not shown in the drawings, according to another embodiment of the disclosure, the connection portion 140 may be in any one shape of a Bezier curve, a Hermite curve, or a B-spline curve. The above-mentioned curves may ensure curvature continuity, and have a high shape degree of freedom due to smooth changes of curvatures.

Hereinafter, various embodiments of the disclosure will be described. In the following embodiments, descriptions about the same components as those described above in the above-described embodiments will be omitted.

Figure 6:
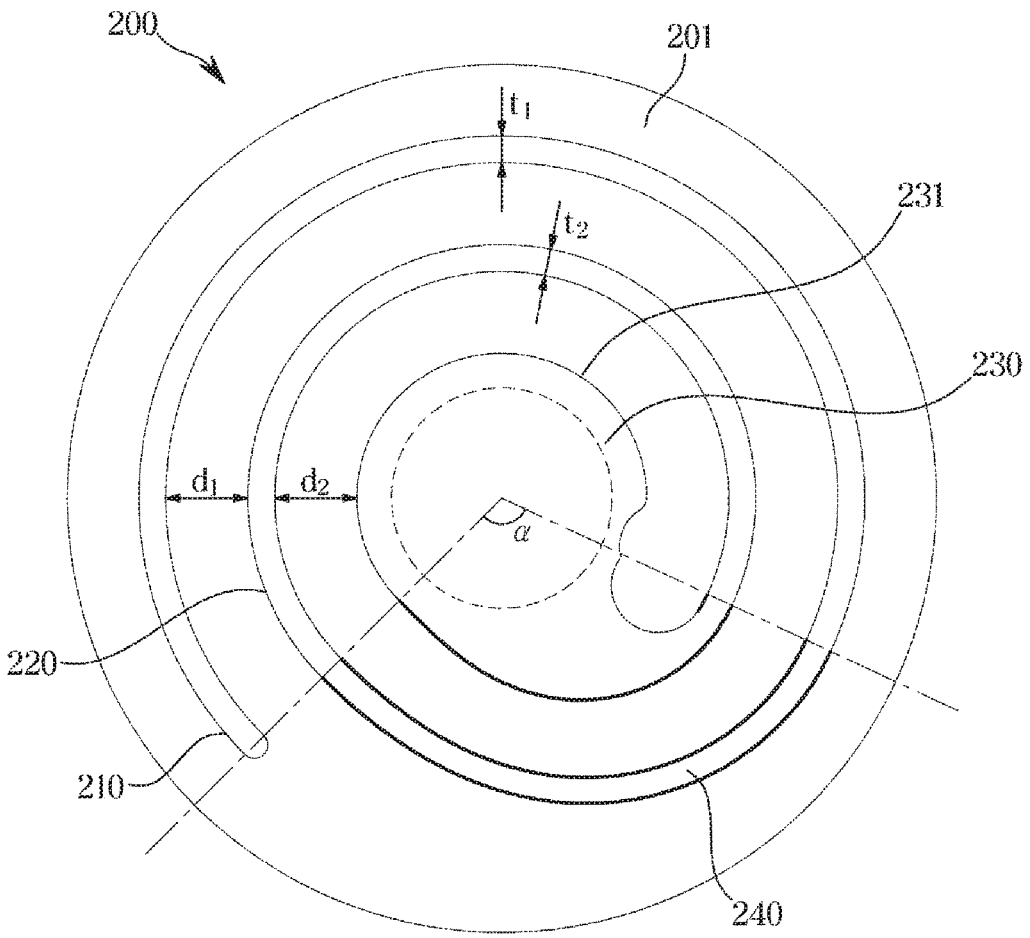
FIG. 6 is a top view of an orbiting scroll in a scroll compressor according to another embodiment of the disclosure.

FIG. 6 is a top view of an orbiting scroll in a scroll compressor according to another embodiment of the disclosure. As described above, an orbiting wrap shape of an orbiting scroll will be described as an example, however, the orbiting wrap shape of the orbiting scroll is also applicable to a fixing wrap of a fixed scroll.

Referring to FIG. 6, an orbiting scroll 200 may include an end plate 201, and an orbiting wrap protruding above the end plate 201. The orbiting wrap may include a first circular arc portion 210 having a constant curvature, a second circular arc portion 220 positioned in an inside of the first circular arc portion 210 and having a constant curvature, and a connection portion 240 connecting the first circular arc portion 210 to the second circular arc portion 220. In an inside of the second circular arc portion 220, a shaft coupling portion 230 may be positioned, and an outer surface of the shaft coupling portion 230 may form a third circular arc portion 231. The third circular arc portion 231 may be in a shape of a small arc of which a center is at the same location as those of the first circular arc portion 210 and the second circular arc portion 220 and which has a smaller radius than the second circular arc portion 220.

A thickness of the first circular arc portion 210 may be t1. A thickness of the second circular arc portion 220 may be t2. The thickness t1 of the first circular arc portion 210 may be equal to the thickness t2 of the second circular arc portion 220. Accordingly, t1=t2 may be satisfied. Also, a distance d1 between the first circular arc portion 210 and the second circular arc portion 220 may be equal to a distance d2 between the second circular arc portion 220 and the third circular arc portion 231. Accordingly, d1=d2 may be satisfied.

According to another embodiment of the disclosure, an included angle α of a line segment connecting one end of the connection portion 240 to a center of an orbiting scroll 200 and a line segment connecting the other end of the connection portion 240 to the center of the orbiting scroll 200 may be 100°. In FIG. 6, the included angle α is shown to be 100°, however, the included angle α of 100° is an example. According to an embodiment of the disclosure, the included angle α may be 100° or more.

Figure 7:
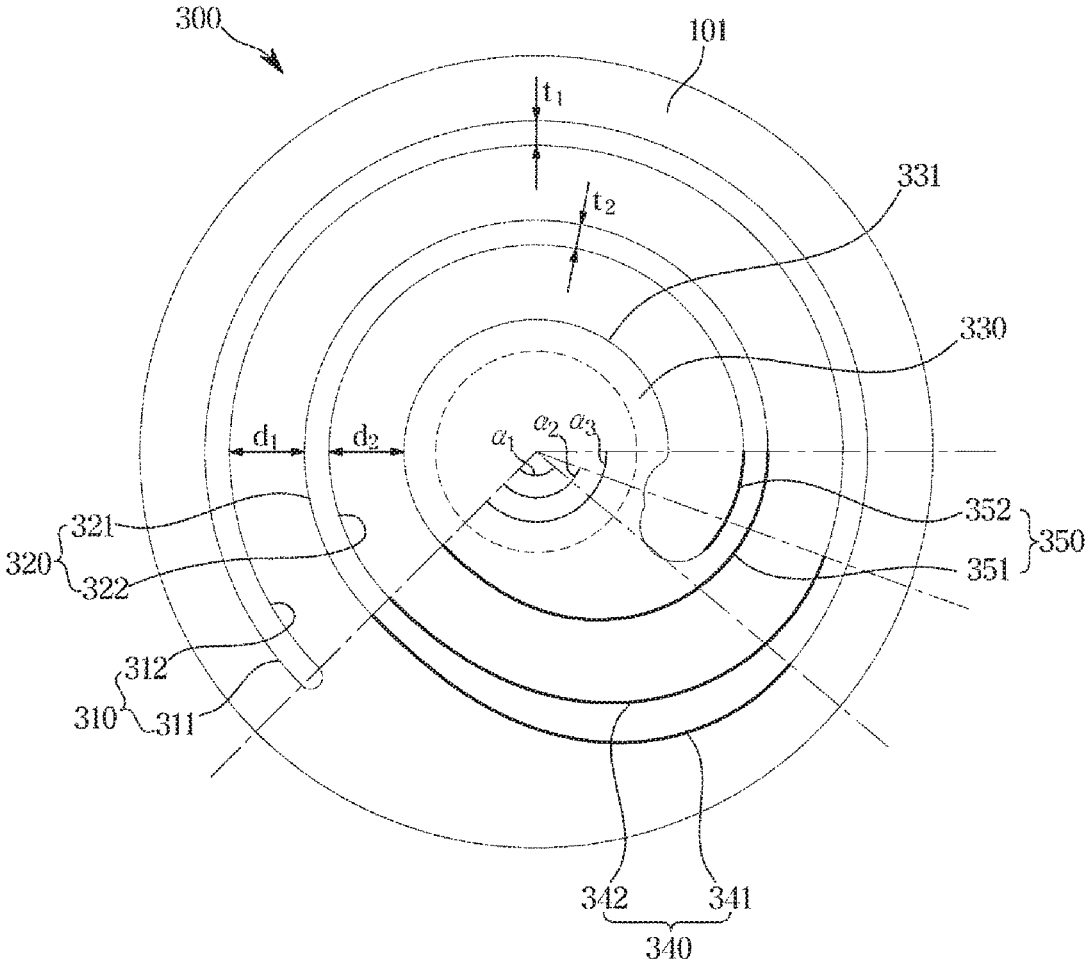
FIG. 7 is a top view of an orbiting scroll in a scroll compressor according to another embodiment of the disclosure.

The connection portion 240 may be in any one shape of a cosine curve, a Bezier curve, a Hermite curve, or a B-spline curve. FIG. 7 is a top view of an orbiting scroll in a scroll compressor according to another embodiment of the disclosure.

Referring to FIG. 7, each of a first circular arc portion 310 and a second circular arc portion 320 may include an outer surface and an inner surface. More specifically, the first circular arc portion 310 may include an outer surface 311 and an inner surface 312. The second circular arc portion 320 may include an outer surface 321 and an inner surface 322.

Also, a connection portion may include a first connection portion 340 connecting the first circular arc portion 310 to the second circular arc portion 320, and a second connection portion 350 connecting the second circular arc portion 320 to a shaft coupling portion 330.

The first connection portion 340 may include an outer surface 341 and an inner surface 342, and the second connection portion 350 may include an outer surface 351 and an inner surface 352. Hereinafter, the outer surface 341 and the inner surface 342 of the first connection portion 340 may indicate a first connection surface and a second connection surface, respectively. The outer surface 351 of the second connection portion 350 may indicate a third connection surface.

According to another embodiment of the disclosure, the connection portion may include the first connection surface 341 connecting the outer surface 311 of the first circular arc portion 310 to the outer surface 321 of the second circular arc portion 320, the second connection surface 342 connecting the inner surface 312 of the first circular arc portion 310 to the inner surface 322 of the second circular arc portion 320, and the third connection surface 351 connecting the outer surface 321 of the second circular arc portion 320 to a third circular arc portion 331.

The connection portion may be in any one shape of a cosine curve, a Bezier curve, a Hermite curve, or a B-spline curve.

Referring to FIG. 7, an included angle of a line segment connecting one end of the first connection surface 341 to a center of an orbiting scroll 300 and a line segment connecting the other end of the first connection surface 341 to the center of the orbiting scroll 300 may be $\alpha_1$. Also, an included angle of a line segment connecting one end of the second connection surface 342 to the center of the orbiting scroll 300 and a line segment connecting the other end of the second connection surface 342 to the center of the orbiting scroll 300 may be $\alpha_2$. Also, an included angle of a line segment connecting one end of the third connection surface 351 to the center of the orbiting scroll 300 and a line segment connecting the other end of the third connection surface 343 to the center of the orbiting scroll 300 may be $\alpha_3$.

According to another embodiment of the disclosure, the included angle $\alpha_1$, the included angle $\alpha_2$, and the included angle $\alpha_3$ may be different from each other. More specifically, the included angle $\alpha_3$ may be greater than the included angle $\alpha_2$, and the included angle $\alpha_2$ may be greater than the included angle $\alpha_1$. For example, as shown in FIG. 7, the included angle $\alpha_1$ may be 95°, the included angle $\alpha_2$ may be 115°, and the included angle $\alpha_3$ may be 135°.

Figure 8:
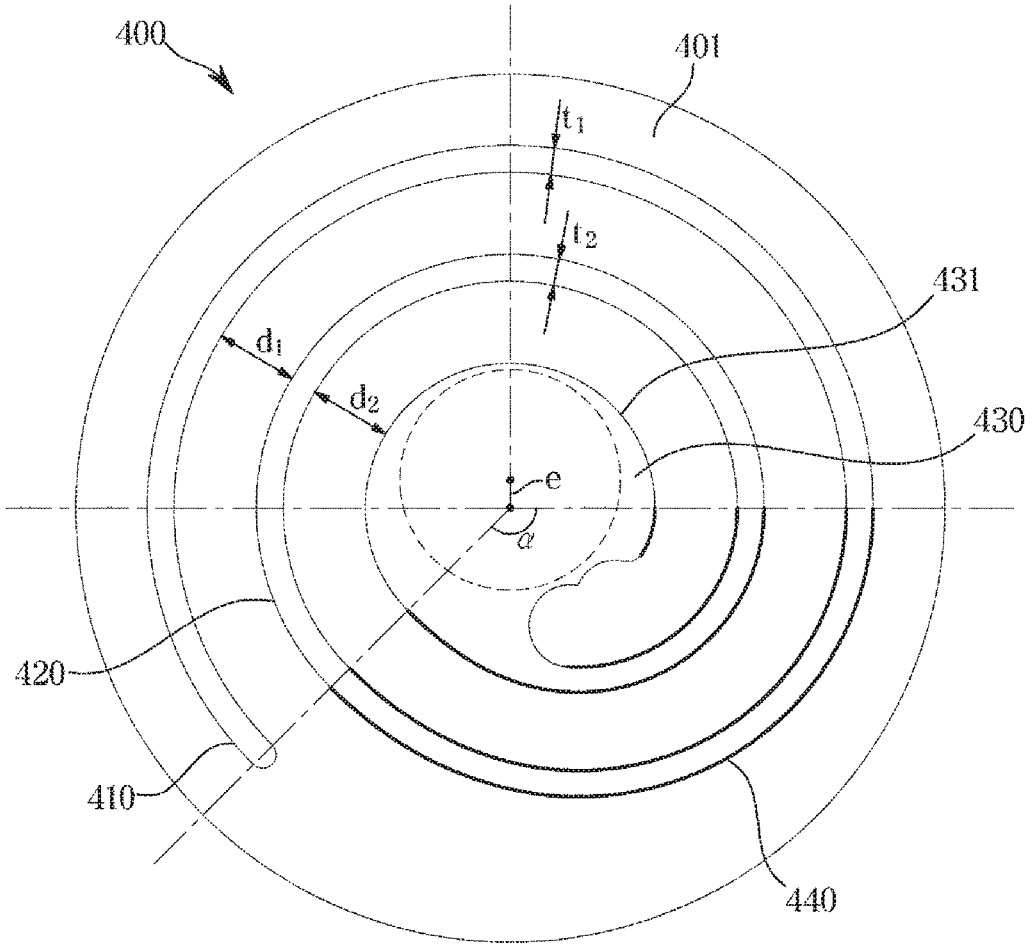
FIG. 8 is a top view of an orbiting scroll in a scroll compressor according to another embodiment of the disclosure.

FIG. 8 is a top view of an orbiting scroll in a scroll compressor according to another embodiment of the disclosure.

Referring to FIG. 8, an orbiting scroll 400 may include an end plate 401, and an orbiting wrap protruding above the end plate 401. The orbiting wrap may include a first circular arc portion 410 having a constant curvature, a second circular arc portion 420 positioned in an inside of the first circular arc portion 410 and having a constant curvature, and a connection portion 440 connecting the first circular arc portion 410 to the second circular arc portion 420. In an inside of the second circular arc portion 420, a shaft coupling portion 430 may be positioned, and an outer surface of the shaft coupling portion 430 may form a third circular arc portion 431. The third circular arc portion 431 may be in a shape of a small arc of which a center is at the same location as those of the first circular arc portion 410 and the second circular arc portion 420 and which has a smaller radius than the second circular arc portion 420.

A thickness of the first circular arc portion 410 may be t1. A thickness of the second circular arc portion 420 may be t2. The thickness t1 of the first circular arc portion 410 may be equal to the thickness t2 of the second circular arc portion 420. Accordingly, t1=t2 may be satisfied. Also, a distance d1 between the first circular arc portion 410 and the second circular arc portion 420 may be equal to a distance d2 between the second circular arc portion 420 and the third circular arc portion 431. Accordingly, d1=d2 may be satisfied.

The connection portion may be in any one shape of a cosine curve, a Bezier curve, a Hermite curve, or a B-spline curve. Referring to FIG. 8, in the scroll compressor according to another embodiment of the disclosure, the shaft center of the eccentric portion 42 may be eccentric by a preset distance from a center of the orbiting scroll 400. For example, the shaft center of the eccentric portion 42 may be eccentric by a distance e in an up direction from the center of the orbiting scroll 400, as shown in FIG. 8. Through the structure, the scroll compressor according to another embodiment of the disclosure may reduce a size of a shaft coupling portion 430. Accordingly, a compression space of the scroll compressor may be expanded, and furthermore, a design volume ratio may increase.

Figure 9:
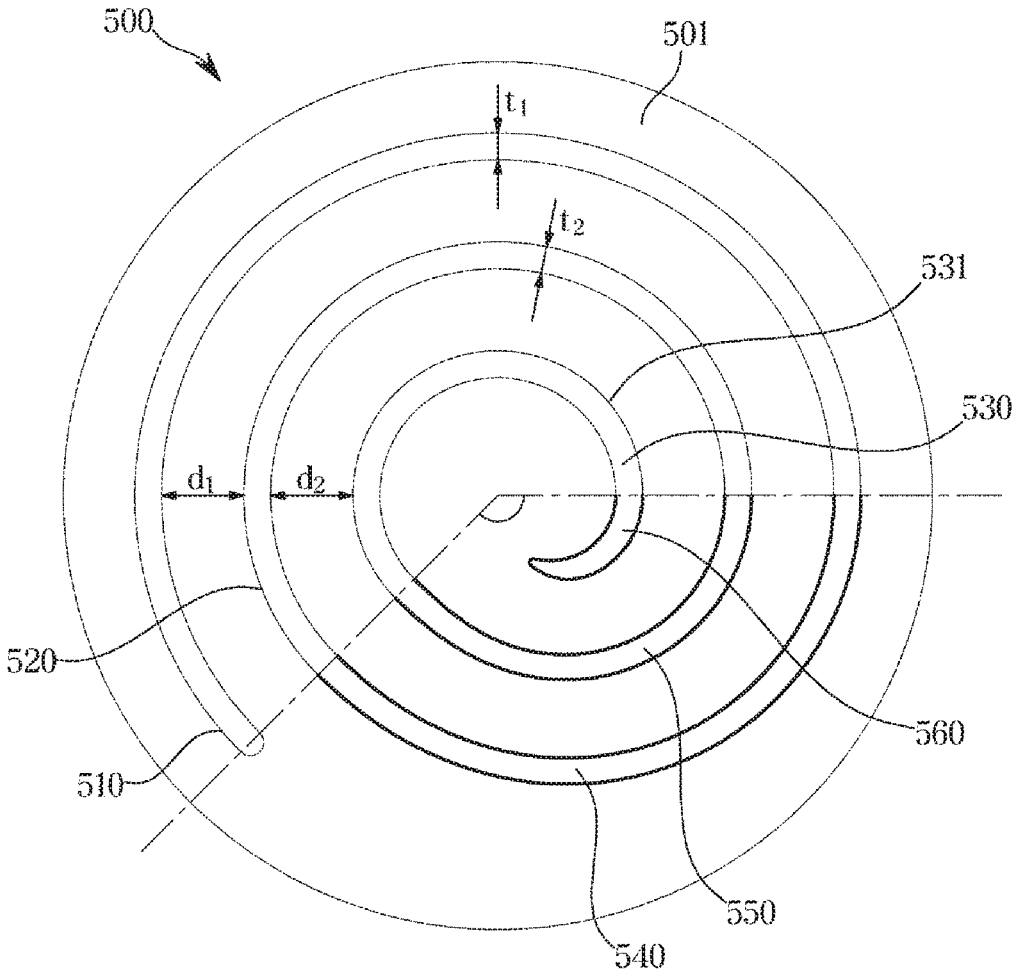
FIG. 9 is a top view of an orbiting scroll in a scroll compressor according to another embodiment of the disclosure.

FIG. 9 is a top view of an orbiting scroll in a scroll compressor according to another embodiment of the disclosure.

Referring to FIG. 9, according to another embodiment of the disclosure, the scroll compressor may be a general scroll compressor, neither a semi shaft penetration scroll compressor nor a shaft penetration scroll compressor. The general scroll compressor may have a structure in which an eccentric portion of a rotation shaft is inserted in a boss portion protruding below an end plate 501 of an orbiting scroll 500, wherein an orbiting wrap may be formed over the entire upper area of the end plate 501 of the orbiting scroll 500. The general scroll compressor is advantageous in view of a compression space and a design volume ratio.

According to another embodiment of the disclosure, the scroll compressor may have a general scroll compressor structure in which an orbiting wrap includes a plurality of circular arc portions 510, 520, and 530 having a constant curvature and connection portions 540, 550, and 560 connecting the circular arc portions 510, 520, and 530 to each other. The circular arc portions 510, 520, and 530 may include a first circular arc portion 510, a second circular arc portion 520 positioned in an inside of the first circular arc portion 510 and spaced from the first circular arc portion 510, and a third circular arc portion 530 positioned in an inside of the second circular arc portion 520 and spaced from the second circular arc portion 520. The connection portions 540, 550, and 560 may include a first connection portion 540 connecting one end of the first circular arc portion 510 to one end of the second circular arc portion 520, a second connection portion 550 connecting the other end of the second circular arc portion 520 to one end of the third circular arc portion 530, and a third connection portion 560 extending from the other end of the third circular arc portion 530. Each of the connection portions 540, 550, and 560 may be in a shape of a part of a cosine curve, and have a curvature changing successively between the circular arc portions 510, 520, and 530. In contrast, the connection portions 540, 550, and 560 may be in any one shape of a Bezier curve, a Hermite curve, or a B-spline curve. Through the structure, a compression space may be expanded compared to a wrap of an involute structure, and a design volume ratio may increase.

Figure 10:
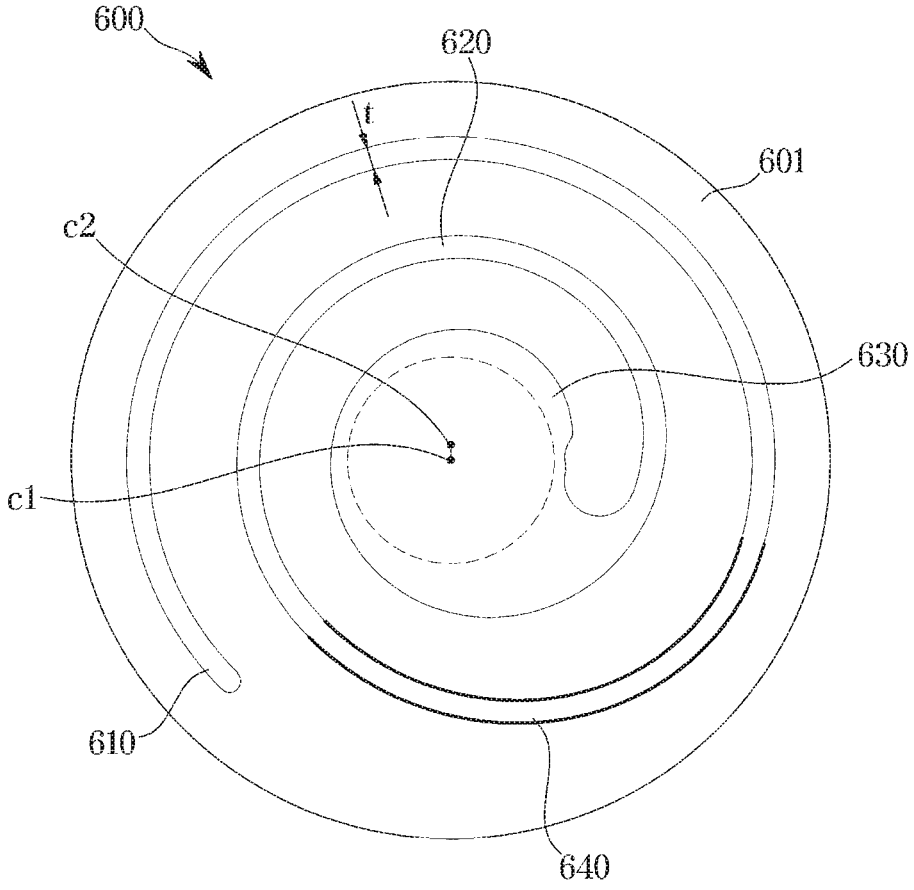
FIG. 10 is a top view of an orbiting scroll in a scroll compressor according to another embodiment of the disclosure.

FIG. 10 is a top view of an orbiting scroll in a scroll compressor according to another embodiment of the disclosure.

Referring to FIG. 10, an orbiting scroll 600 may have a structure of a semi shaft penetration scroll compressor or a shaft penetration scroll compressor. The orbiting scroll 600 may include an end plate 601, and an orbiting wrap protruding above the end plate 601. The orbiting wrap may include a circular arc portion 610 having a constant curvature, a shaft coupling portion 620 which is positioned in an inside of the circular arc portion 610 and in which the eccentric portion 42 (see FIG. 1) is inserted, and a connection portion 630 connecting the circular arc portion 610 to the shaft coupling portion 620.

The circular arc portion 610 may be in a shape of an arc having a preset radius. The shaft coupling portion 620 may be in a shape of an involute curve of which a center is off set. In other words, the shaft coupling portion 620 may be in a shape of an involute curve having a center c2 which is off set from a center c1 of the end plate 601 having a circular shape. The eccentric portion 42 may be inserted in a center portion of the shaft coupling portion 620.

The connection portion 630 may connect one end of the circular arc portion 610 to one end of the shaft coupling portion 620. The connection portion 630 may be in any one shape of a cosine curve, a Bezier curve, a Hermite curve, or a B-spline curve. The above-mentioned curves may ensure curvature continuity, and have a high shape degree of freedom due to smooth changes of curvatures.

Also, as described above, the connection portion 630 may be in any one shape of a Bezier curve, a Hermite curve, or a B-spline curve. Hereinafter, the Bezier curve, the Hermite curve, or the B-spline curve is also referred to as a connection curve.

According to another embodiment of the disclosure, because the connection portion 630 is in a shape of a connection curve, the thickness t of the orbiting wrap may be optimized by adjusting a weight of the connection curve. In other words, by adjusting a weight of the connection curve in a process of optimizing the thickness of the orbiting wrap, the thickness t of the orbiting wrap may be finely adjusted. As described above, the connection curve may ensure curvature continuity, and have a high shape degree of freedom due to smooth changes of curvatures. By adjusting the weight using the characteristic of the connection curve, the wrap thickness t may be easily optimized.

Figure 11:
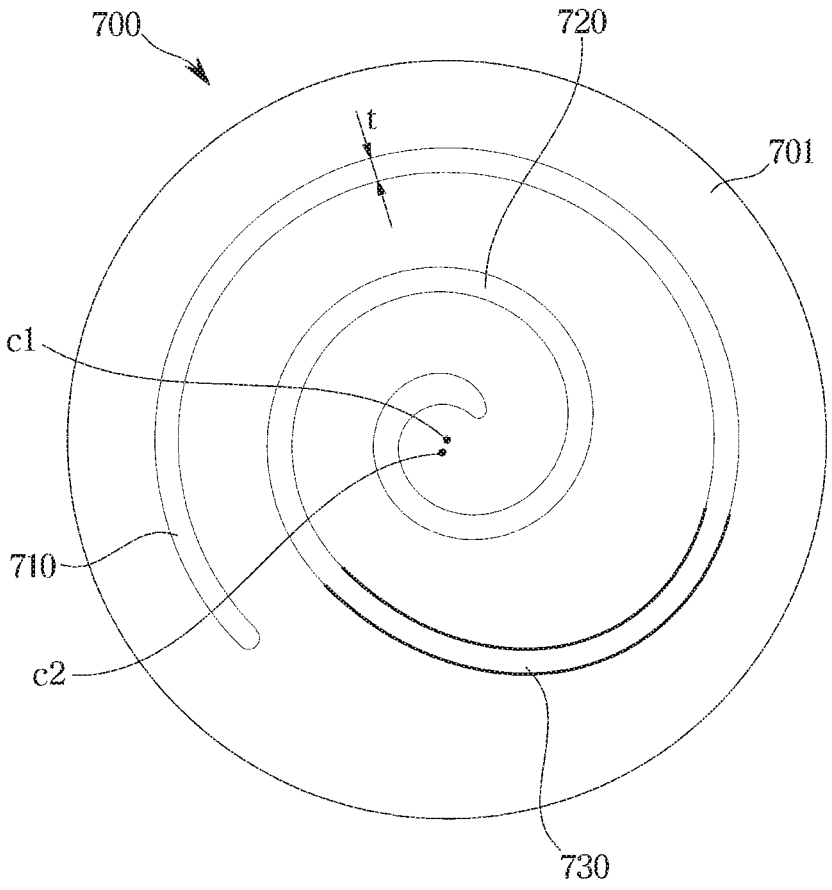
FIG. 11 is a top view of an orbiting scroll in a scroll compressor according to another embodiment of the disclosure.

FIG. 11 is a top view of an orbiting scroll in a scroll compressor according to another embodiment of the disclosure.

Referring to FIG. 11, an orbiting scroll 700 may have a general scroll compressor structure. The orbiting scroll 700 may include an end plate 701, and an orbiting wrap protruding above the end plate 701. The orbiting wrap may include a circular arc portion 710 having a constant curvature, a curved portion 720 positioned in an inside of the circular arc portion 710, and a connection portion 730 connecting the circular arc portion 710 to the curved portion 720.

The circular arc portion 710 may be in a shape of an arc having a preset radius. The curved portion 720 may be in a shape of an involute curve of which a center is off set. In other words, the curved portion 720 may be in a shape of an involute curve having a center c2 which is off set from a center c1 of the end plate 701 having a circular shape.

The connection portion 730 may connect one end of the circular arc portion 710 to one end of the curved portion 720. The connection portion 730 may be in any one shape of a cosine curve, a Bezier curve, a Hermite curve, or a B-spline curve. The above-mentioned curves may ensure curvature continuity, and have a high shape degree of freedom due to smooth changes of curvatures.

Also, as described above, the connection portion 730 may be in any one shape of a Bezier curve, a Hermite curve, or a B-spline curve. Hereinafter, the Bezier curve, the Hermite curve, or the B-spline curve is also referred to as a connection curve.

According to another embodiment of the disclosure, because the connection portion 730 is in a shape of a connection curve, the thickness t of the orbiting wrap may be optimized by adjusting a weight of the connection curve. In other words, by adjusting a weight of the connection curve in a process of optimizing the thickness of the orbiting wrap, the wrap thickness t may be finely adjusted. As described above, the connection curve may ensure curvature continuity and have a high shape degree of freedom due to smooth changes of curvatures. By adjusting the weight using the characteristic of the connection curve, the wrap thickness t may be easily optimized. According to a concept of the disclosure, a scroll compressor capable of increasing a design volume ratio by changing a shape of a wrap may be provided.

Figure 12:
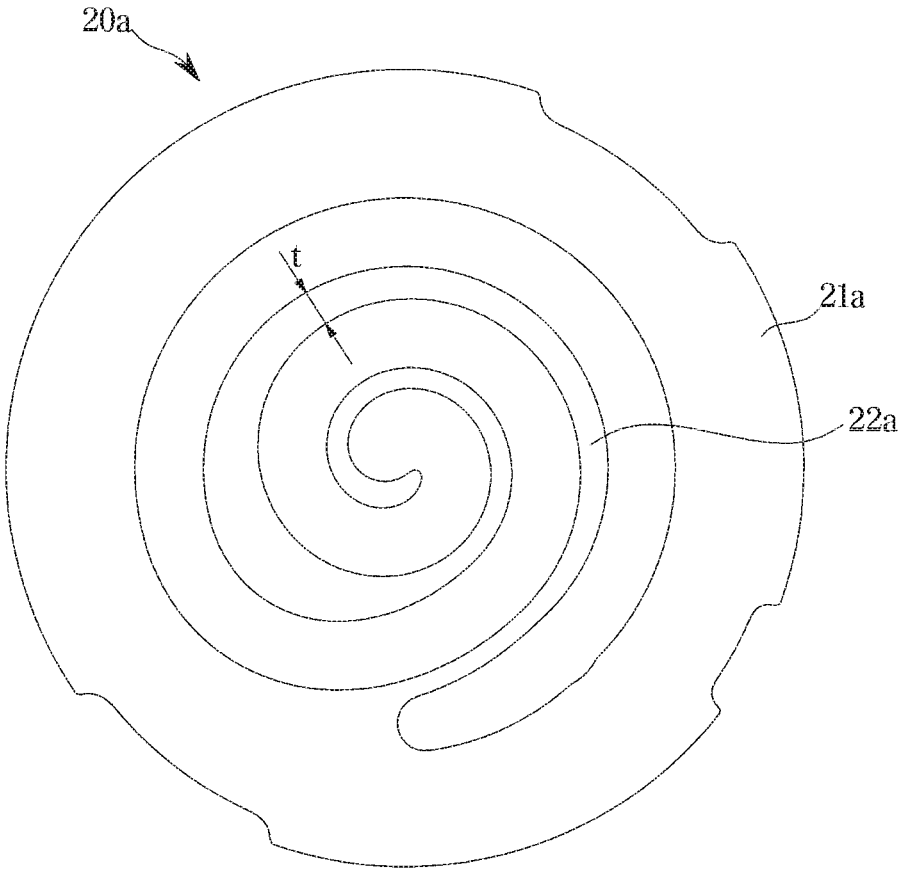
FIG. 12 is a top view of a fixed scroll corresponding to an orbiting scroll shown in FIG. 11.

FIG. 12 is a top view of a fixed scroll corresponding to an orbiting scroll shown in FIG. 11.

Referring to FIG. 12, a fixed scroll 20*a* may include an end plate 21*a* being in a shape of a disk, and a fixing wrap 22*a* extending downward from the end plate 21*a* and forming a compression chamber 50 (see FIG. 1) together with an orbiting wrap. FIG. 12 is a top view showing the fixed wrap 20*a* of the fixed scroll 20*a* after being arranged to face upward.

According to another embodiment of the disclosure, the thickness t of the fixed wrap 22*a* of the fixed scroll 20*a* may satisfy the following equation.

$$2\times T_{min}\leq T_{max}\leq 2\times(T_{min}+e)$$

Herein, e represents an eccentric distance, and the eccentric distance is a distance between a center of the rotation shaft 40 and a center of the eccentric portion 42 as shown in FIG. 1. Also, $T_{min}$ represents a minimum thickness of the fixed wrap 22*a*, and $T_{max}$ represents a maximum thickness of the fixed wrap 22*a*. According to another embodiment of the disclosure, when the thickness t of the fixed wrap 22*a* satisfies the above equation, a technical effect of reductions of a trust area and trust loss through optimization of the fixed wrap thickness may be achieved.

Although not shown in the drawing, a thickness of a fixed wrap of a fixed scroll corresponding to the orbiting scroll shown in FIG. 10 may satisfy the following equation.

$$2\times T_{min}\leq T_{max}\leq 2\times(T_{min}+e)$$

Herein, e represents an eccentric distance, and the eccentric distance is a distance between a center of the rotation shaft 40 and a center of the eccentric portion 42 as shown in FIG. 1. Also, $T_{min}$ represents a minimum thickness of the fixed wrap, and $T_{max}$ represents a maximum thickness of the fixed wrap. According to another embodiment of the disclosure, when the thickness t of the fixed wrap satisfies the above equation, a technical effect of reductions of a trust area and trust loss through optimization of the fixed wrap thickness may be achieved.

According to a concept of the disclosure, a scroll compressor capable of expanding a compression space by changing a shape of a wrap may be provided.

According to a concept of the disclosure, a shaft penetration scroll compressor or a semi shaft penetration scroll compressor capable of increasing a design volume ratio by including a new shape of a wrap structure may be provided.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A scroll compressor comprising:

a main body;

a fixed scroll fixed inside the main body;

an orbiting scroll configured to orbit the fixed scroll; and a plurality of compressing portions respectively provided in the fixed scroll and the orbiting scroll, each compressing portion among the plurality of compressing portions including:

a circular arc portion of which a curvature is constant, a curved portion positioned in an inside of the circular arc portion and spaced a preset distance from the circular arc portion, a connection portion formed to connect the circular arc portion to the curved portion, and a rotation shaft rotating with respect to a rotation axis and including an eccentric portion being eccentric from the rotation axis, wherein the eccentric portion is positioned alongside a compressing portion of the plurality of compressing portions in a direction crossing the rotation axis, wherein a curvature of the connection portion changes from the circular arc portion to the curved portion, and the connection portion is in a shape of a Bezier curve, a Hermite curve, or a B-spline curve, wherein the circular arc portion is referred to as a first circular arc portion, and the curved portion is referred to as a second circular arc portion, wherein a distance from a center of the compressing portion to the connection portion is R, a distance from the center of the compressing portion to the first circular arc portion is $R_1$, a distance from the center of the compressing portion to the second circular arc portion is $R_2$, a thickness of the first circular arc portion is t, a distance by which a center of the eccentric portion is eccentric from a center of the rotation shaft is ε, an angle of one end of the first circular arc portion with respect to a preset reference line is $\theta_1$, an angle of one end of the second circular arc portion with respect to the preset reference line is $\theta_2$, an angle of a point of the connection portion with respect to the preset reference line is θ, and $$R = R_1 - (\varepsilon + t) + (\varepsilon + t)\cos\varphi,\ \varphi = -\frac{180}{\alpha}\cos(\theta - \theta_1),\ \alpha = \theta_1 - \theta_2$$

is satisfied.

2. The scroll compressor of claim 1, wherein the second circular arc portion is in a shape of an arc of which a curvature is constant.

3. The scroll compressor of claim 2, wherein each of the first circular arc portion and the second circular arc portion has a constant thickness, and the thickness of the first circular arc portion is the same as the thickness of the second circular arc portion.

4. The scroll compressor of claim 1, wherein the compressing portion further comprises a shaft coupling portion positioned in an inside of the second circular arc portion and spaced a preset distance from the second circular arc portion, wherein the eccentric portion is coupled to the shaft coupling portion, wherein the shaft coupling portion comprises a third circular arc portion forming an outer surface of the shaft coupling portion, wherein a curvature of the third circular arc portion is constant.

5. The scroll compressor of claim 4, wherein a distance between the first circular arc portion and the second circular arc portion is equal to a distance between the second circular arc portion and the third circular arc portion.

6. The scroll compressor of claim 4, wherein the connection portion comprises:

a first connection portion connecting the first circular arc portion to the second circular arc portion, and a second connection portion connecting the second circular arc portion to the third circular arc portion, wherein a curvature of the second connection portion changes from the second circular arc portion to the third circular arc portion.

7. The scroll compressor of claim 6, wherein each of the first circular arc portion and the second circular arc portion includes an outer surface and an inner surface, and the third circular arc portion includes an outer surface.

8. The scroll compressor of claim 7, wherein the first connection portion comprises a first connection surface connecting the outer surface of the first circular arc portion to the outer surface of the second circular arc portion, and a second connection surface connecting the inner surface of the first circular arc portion to the inner surface of the second circular arc portion, and the second connection portion comprises a third connection surface connecting the outer surface of the second circular arc portion to the outer surface of the third circular arc portion.

9. The scroll compressor of claim 8, wherein a first angle which is an included angle of a line segment connecting one end of the first connection surface to the center of the compressing portion and a line segment connecting the other end of the first connection surface to the center of the compressing portion, a second angle which is an included angle of a line segment connecting one end of the second connection surface to the center of the compressing portion and a line segment connecting the other end of the second connection surface to the center of the compressing portion, and a third angle which is an included angle of a line segment connecting one end of the third connection surface to the center of the compressing portion and a line segment connecting the other end of the third connection surface to the center of the compressing portion are different from each other.

10. The scroll compressor of claim 9, wherein the first angle is 95°, the second angle is 115°, and the third angle is 135°.

11. The scroll compressor of claim 4, wherein a center of the shaft coupling portion is out of the center of the compressing portion.

12. The scroll compressor of claim 1, wherein the curved portion is in a shape of an involute curve having a center which is off set from a center of the fixed scroll or the orbiting scroll.

13. A scroll compressor comprising:

a main body;

a fixed scroll fixed inside the main body;

an orbiting scroll configured to orbit the fixed scroll; and a plurality of compressing portions respectively provided in the fixed scroll and the orbiting scroll, wherein each compressing portion among the plurality of compressing portions includes:

a first circular arc portion being in a shape of an arc, a second circular arc portion positioned in an inside of the first circular arc portion, wherein a center of the second circular arc portion is at the same location as a center of the first circular arc portion, and a thickness of the second circular arc portion is the same as a thickness of the first circular arc portion, a connection portion formed to connect the first circular arc portion to the second circular arc portion, wherein a curvature of the connection portion changes successively from the first circular arc portion to the second circular arc portion, and a rotation shaft rotating with respect to a rotation axis and including an eccentric portion being eccentric from the rotation axis, wherein the eccentric portion is positioned alongside the compressing portion in a direction crossing the rotation axis, wherein the connection portion of the plurality of compressing portions is in a shape of a Bezier curve, a Hermite curve, or a B-spline curve, wherein a distance from a center of the compressing portion to the connection portion is R, a distance from the center of the compressing portion to the first circular arc portion is $R_1$, a distance from the center of the compressing portion to the second circular arc portion is $R_2$, a thickness of the first circular arc portion is t, a distance by which a center of the eccentric portion is eccentric from a center of the rotation shaft is ε, an angle of one end of the first circular arc portion with respect to a preset reference line is $\theta_1$, an angle of one end of the second circular arc portion with respect to the preset reference line is $\theta_2$, an angle of a point of the connection portion with respect to the preset reference line is θ, and $$R = R_1 - (\varepsilon + t) + (\varepsilon + t)\cos\varphi,\ \varphi = -\frac{180}{\alpha}\cos(\theta - \theta_1),\ \alpha = \theta_1 - \theta_2$$

is satisfied.

14. The scroll compressor of claim 13, wherein the connection portion is in a shape of a cosine curve.

15. A scroll compressor, comprising:

a main body;

a fixed scroll fixed inside the main body and including a first end plate and a fixing wrap formed on the first end plate;

an orbiting scroll configured to orbit the fixed scroll, and including a second end plate being opposite to the first end plate, and an orbiting wrap and a shaft coupling portion formed in the second end plate; and a rotation shaft including an eccentric portion being eccentric from a rotation axis, the rotation shaft coupled to the shaft coupling portion, wherein the eccentric portion penetrates the second end plate, wherein the orbiting wrap includes:

a first circular arc portion having an arc shape, a second circular arc portion positioned in an inside of the first circular arc portion and spaced apart from the first circular arc portion, and a connection portion formed to connect the first circular arc portion to the second circular arc portion, wherein a curvature of the connection portion changes from the first circular arc portion to the second circular arc portion, wherein the connection portion is in a shape of a Bezier curve, a Hermite curve, or a B-spline curve, wherein a distance from a center of the compressing portion to the connection portion is R, a distance from the center of the compressing portion to the first circular arc portion is $R_1$, a distance from the center of the compressing portion to the second circular arc portion is $R_2$, a thickness of the first circular arc portion is t, a distance by which a center of the eccentric portion is eccentric from a center of the rotation shaft is ε, an angle of one end of the first circular arc portion with respect to a preset reference line is $\theta_1$, an angle of one end of the second circular arc portion with respect to the preset reference line is $\theta_2$, an angle of a point of the connection portion with respect to the preset reference line is θ, and $$R = R_1 - (\varepsilon + t) + (\varepsilon + t)\cos\varphi,\ \varphi = -\frac{180}{\alpha}\cos(\theta - \theta_1),\ \alpha = \theta_1 - \theta_2$$

is satisfied.

* * * * *